US008825312B2

(12) United States Patent
Smieja et al.

(10) Patent No.: US 8,825,312 B2
(45) Date of Patent: Sep. 2, 2014

(54) SYSTEM AND METHOD FOR PAVER SCREED ENDGATE CONTROL

(75) Inventors: Jameson Michael Smieja, Brooklyn Park, MN (US); Luke Edward Graham, Maple Grove, MN (US); Tobin Rasmusson, Bloomington, MN (US); Steven Michael Haas, Shakopee, MN (US); Jason William Kopacz, Saint Louis Park, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 173 days.

(21) Appl. No.: 13/425,639

(22) Filed: Mar. 21, 2012

(65) Prior Publication Data

US 2013/0253780 A1 Sep. 26, 2013

(51) Int. Cl.
*G06F 7/70* (2006.01)

(52) U.S. Cl.
USPC ..... 701/50; 404/84.1; 404/84.5

(58) Field of Classification Search
USPC ..... 701/49, 50; 404/84.1, 84.2, 84.5, 118
See application file for complete search history.

(56) References Cited

U.S. PATENT DOCUMENTS

| | | | | |
|---|---|---|---|---|
| 3,564,986 | A * | 2/1971 | Burgin | 404/84.2 |
| 4,802,787 | A | 2/1989 | Bays | |
| 5,362,176 | A | 11/1994 | Sovik | |
| 5,401,115 | A | 3/1995 | Musil et al. | |
| 5,568,992 | A | 10/1996 | Grembowicz et al. | |
| 5,752,783 | A | 5/1998 | Malone | |
| 6,056,474 | A | 5/2000 | Nolan | |
| 6,074,129 | A | 6/2000 | Nowak et al. | |
| 6,481,925 | B1 | 11/2002 | Olson | |
| 6,890,125 | B1 | 5/2005 | Calder et al. | |
| 6,981,820 | B2 | 1/2006 | Nelson | |
| 7,121,763 | B1 | 10/2006 | Young et al. | |
| 7,172,363 | B2 | 2/2007 | Olson et al. | |
| 7,217,062 | B2 | 5/2007 | Pisano et al. | |
| 7,427,174 | B2 | 9/2008 | Dearing | |
| 7,484,911 | B2 | 2/2009 | Frelich | |
| 7,497,641 | B1 | 3/2009 | Frelich | |
| 7,604,433 | B2 | 10/2009 | Face, III et al. | |
| 7,641,419 | B1 | 1/2010 | Nelson | |
| 7,651,295 | B2 | 1/2010 | Eppes et al. | |

(Continued)

FOREIGN PATENT DOCUMENTS

| | | |
|---|---|---|
| JP | 1994/000260049 | 5/1996 |

OTHER PUBLICATIONS

"Linear Variable Differential Transformer", Wikipedia, the free encyclopedia, Jul. 21, 2011.

*Primary Examiner* — Thomas Tarcza
*Assistant Examiner* — Kevin Myhre
(74) *Attorney, Agent, or Firm* — Miller, Matthias & Hull

(57) ABSTRACT

A height adjustment system for a paving screed apparatus and a method for adjusting the height of the endgates of a screed system are disclosed. In a disclosed system, the system includes an endgate coupled to a biasing element, such as a spring or a hydraulic cylinder and rod. The biasing element is coupled to an actuator. The actuator is linked to a controller. The biasing element is moveable between a compressed position and an extended position with a setpoint range disposed between the compressed and extended positions. The biasing element is also associated with a sensor for measuring vertical displacement of the biasing element, pressure or load on the biasing element with respect to the setpoint range.

25 Claims, 13 Drawing Sheets

(56) References Cited

U.S. PATENT DOCUMENTS

| | | | | |
|---|---|---|---|---|
| 7,856,302 | B2 | 12/2010 | Rasmussen | |
| 7,909,534 | B1 | 3/2011 | Comer et al. | |
| 7,946,787 | B2 | 5/2011 | Glee et al. | |
| 2007/0150148 | A1* | 6/2007 | Rasmussen | 701/50 |
| 2011/0085859 | A1 | 4/2011 | Yost | |
| 2011/0255918 | A1 | 10/2011 | Worsley et al. | |

* cited by examiner

SYSTEM AND METHOD FOR PAVER SCREED ENDGATE CONTROL

TECHNICAL FIELD

This disclosure relates generally paving apparatuses and more specifically to a system and method for controlling the height and attack angle of the endgates of a paving apparatus screed.

BACKGROUND

In conventional asphalt paving operations, a self-propelled vehicle, known as a tractor, is used having a hopper on the front end thereof. The hopper receives asphalt paving material, typically from a dump truck. The asphalt material is transferred from the hopper to the roadbed or other surface being paved in front of transversely extending screw augers. A roadbed or other surface to be paved will be referred to the "reference surface" herein. The augers transport the asphalt material laterally in front of an elongated plate, or "screed", which compresses and compacts the asphalt downwardly to form a "mat" of paving material, ideally of uniform thickness and surface finish.

The screed is typically pulled behind the tractor by tow bars that may allow the screed to may move upwardly or downwardly with respect to the tractor. The tow bars may be pivotally connected to the tractor and may pivot about an axis, or "tow points". This arrangement effectively allows the screed to "float" with respect to the tractor as the screed is towed behind the tractor.

A conventional screed is of a set width. However, in certain paving applications, such as driveways, parking lots, and the like, varying the asphalt mat width is required. As a result, width-adjustable or extendable screed arrangements have become common for varying the width of the asphalt mat without interrupting the paving process. Typically, extendable screeds consist of a main screed section of a fixed width and hydraulically extendable "screed extenders" that are capable of extending from each end of the main screed section. Both extendable and non-extendable screeds may be equipped with endgates that act to maintain the asphalt material between the endgates and in front of the screed and screed extenders and not allow the asphalt material to migrate laterally past the endgates.

In a normal operation of an asphalt paver, an operator makes adjustments in the attack angle of the screed to affect the depth of the asphalt mat being laid. To maintain the asphalt material between the endgates as the screed attack angle is adjusted, the endgates may be extended or retracted with motorized or manually operated jacks. Further, many paving machines include two jacks coupled to each endgate for more accurately maintaining the correct positions of the endgates with respect to the screed extenders or screed, if no screed extenders are provided. The correct position of the endgate is a sliding contact with the reference surface, or the surface being paved. Also, an endgate may need to be extended to ride on top of a curb, while the surface next to the curb is paved.

When the asphalt mat thickness changes incrementally, the endgates, which are typically coupled to springs, may automatically adjust to float at the new paving depth. Because the endgate springs provide only a limited range of vertical motion to the endgates, operators of screeds must continually adjust the endgate height to maintain the endgate springs at or near the spring setpoint by rotating the endgate jacks, which controls the compression and extension of the endgate springs.

By keeping the endgate springs at or near their setpoint, the endgates can "float" as the main screed and the screed extenders come in to contact with various surface grades. If the mat being laid becomes too thick, the endgate springs may reach full extension, resulting in the endgates being lifted off the reference surface. If the mat being laid becomes too thin, the endgate springs may reach full compression which may limit the ability of the screed to float on the thinner mat.

Accordingly, there exists a need for a reliable and easy to use system and method for adjusting the heights of endgates of paving apparatuses.

SUMMARY OF THE DISCLOSURE

A height adjustment system for a paving screed apparatus is disclosed. The height adjustment system includes an endgate coupled to a first spring. The first spring is coupled to a first actuator. The first actuator is linked to a controller. The controller includes a memory. The first spring and endgate are moveable between a compressed position and an extended position with a first setpoint range disposed therebetween. The first setpoint range is stored in the memory of the controller. At least one of the first spring and the endgate are linked to a first sensor. The first sensor is linked to the controller. The first sensor detects an actual position of the first spring and the endgate and communicates the actual position of the first spring and endgate to the controller. The controller is programmed to cause the first actuator to extend the first spring when the first spring and endgate are compressed beyond a first setpoint range. And, the controller is programmed to cause the first actuator to compress the first spring when the first spring and endgate are extended beyond the first setpoint range.

A paving apparatus is also disclosed. The disclosed paving apparatus includes a main screed including a main screed plate disposed between a right extender and a left extender. The right extender is disposed between the main screed plate and a right endgate. The right endgate is coupled to a right spring. The right spring is coupled to a right actuator. The left extender is disposed between the main screed plate and a left endgate. The left endgate is coupled to a left spring. The left spring is coupled to a left actuator. The right and left actuators are linked to a controller. The right spring is moveable between extended and compressed positions with a right setpoint range disposed therebetween. The left spring is moveable between extended and compressed positions with a left setpoint range disposed therebetween. The right spring is linked to a right sensor for measuring displacement of the right spring with respect to the right setpoint range. The left spring is linked to a left sensor for measuring displacement of the left spring with respect to the left setpoint range. The right and left sensors are linked to the controller. The controller is programmed to cause the right actuator to extend the right spring when the right spring is compressed beyond the right setpoint range and the controller is also programmed to cause the right actuator to compress the right spring when the right spring is extended beyond the right setpoint range. The controller is further programmed to cause the left actuator to extend the left spring when the left spring is compressed beyond the left setpoint range and the controller is also programmed to cause the left actuator to compress the left spring when the left spring is extended beyond the left setpoint range.

A method for operating a paving apparatus is also disclosed. The paving apparatus includes a right endgate and a left endgate. Each endgate is coupled to at least one spring. Each of said at least one springs are coupled to a sensor and an actuator. Each actuator and each sensor are linked to a controller. The method includes determining a setpoint range for each spring, receiving signals from each sensor and determining whether each spring is above or below its setpoint range, if at least one of the springs is compressed below its setpoint range, activating its respective actuator and extending said at least one of the springs to adjust said at least one of the springs to a position within its setpoint range, and if at least one of the springs is extended above its setpoint range, activating its respective actuator and compressing said at least one of the springs to adjust said at least one of the springs to a position within its setpoint range.

In any one or more of the embodiments described above, the first setpoint range includes a first setpoint and a first deadband ranging from about +/−5% to about +/−20% of the first setpoint. In anyone or more of the embodiments described above, the controller is further programmed to delay extending the first spring when the first spring is compressed beyond the first setpoint range. Further, the controller is programmed to delay compressing the first spring when the first spring is extended to a position beyond the first setpoint range. In any one or more of the embodiments described above, the first sensor is selected from the group consisting of a linear variable differential transducer, a pressure sensor, a load cell and a sonic sensor. In any one or more of the embodiments described above, the first actuator is selected from the group consisting of an electric motor coupled to a threaded shaft that is coupled to a first spring, a hydraulic control valve coupled to a hydraulic cylinder with an extendable and compressible first shaft that is coupled to the first spring, and a hydraulic control valve coupled to an accumulator that is coupled to a hydraulic cylinder with an extendable and compressible first shaft that is coupled to the first spring. In any one or more of the embodiments described above, the endgate includes a shoe. The shoe has a front end and a rear end. The bottom of the shoe is coupled to the first spring and a second spring that is disposed between the first spring and the rear end of the shoe. The second spring is coupled to a second actuator. The second actuator is linked to the controller. The second spring is moveable between a compressed position and an extended position with a second setpoint range disposed between the compressed and extended positions. The second setpoint range is stored in the memory of the controller. The system also includes a second sensor for detecting an actual position of the second spring. The second sensor is linked to the controller. The controller is programmed to cause the second actuator to extend the second spring when the second spring and endgate are compressed beyond the second setpoint range. Further, the controller is programmed to compress the second actuator when the second spring and endgate are extended beyond the second setpoint range.

In any one or more of the embodiments described above, the second setpoint range may include a second setpoint and a second deadband ranging from about +/−5% to about +/−20% of the second setpoint.

In any one or more of the embodiments described above, the controller is further programmed to delay extending the second spring when the second spring and endgate are compressed beyond the second setpoint range. Further, the controller is programmed to delay compressing the second spring when the second spring is extended to a position beyond the second setpoint range. In any one or more of the embodiments described above, the second sensor is selected from the group consisting of a linear variable differential transducer, a pressure sensor, a load cell and a sonic sensor. In any one or more of the embodiments described above, the second actuator is selected from the group consisting of an electric motor coupled to a threaded second shaft that is coupled to a second spring, a hydraulic control valve coupled to a hydraulic cylinder that includes a second shaft that is coupled to a second spring and a hydraulic control valve coupled to an accumulator that is coupled to a hydraulic cylinder that includes a second shaft that is coupled to the second spring. In any one or more of the embodiments described above, the first actuator and first spring include a first hydraulic cylinder that accommodates a piston connected to a first shaft that retractably extends out of the first cylinder and is coupled to the first endgate.

In any one or more of the described methods, the methods may include delaying for a period of time after receiving the signals from the sensors and before extending or compressing the springs. In any one or more of the methods described above, the method may further including extending and compressing each spring independent of the extending and compressing of the other springs. Finally, in any one or more of the method claims described above, the method may further include providing a grade sensor in front of the endgates that is linked to the controller, receiving at least one signal from the grade sensor at the controller identifying an obstruction and a size of the obstruction in front of the paving apparatus and adjusting the setpoint ranges for each of the springs based on the size of the obstruction.

DETAILED DESCRIPTION

For purposes of this disclosure, the term "coupled" means a direct or indirect connection between two elements. For example, the term coupled can mean that two elements are directly connected together and it can also mean that two elements are connected together through one or more additional elements.

For purposes of this disclosure, the term "linked" means that two electronic components are in communication with each other via hard wiring or a wireless connection.

For purposes of this disclosure, the term "spring" means a biasing element such as a coiled spring, a hydraulic cylinder/piston/shaft combination or other device that may be compressed and extended.

Figure 2:
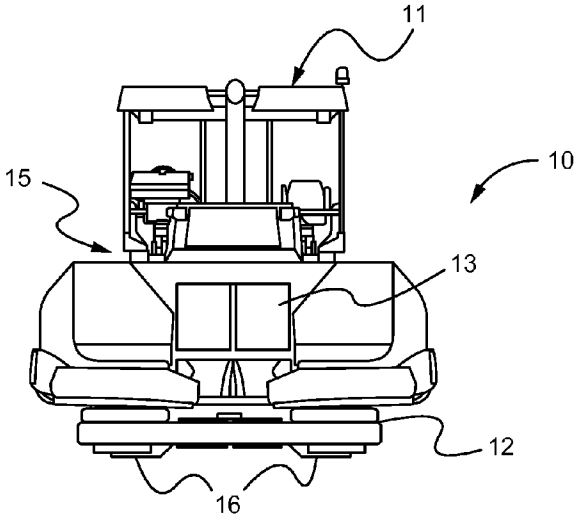
Fig. 2 Prior Art
FIG. 2 is a front plan view of the paving apparatus disclosed in FIG. 1.
Figure 1:
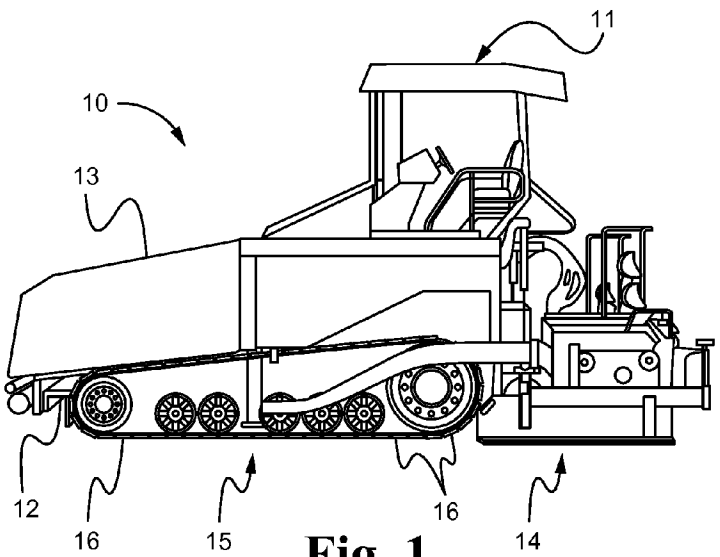
Fig. 1 Prior Art
FIG. 1 is a side plan view of a disclosed paving apparatus.
Figure 3:
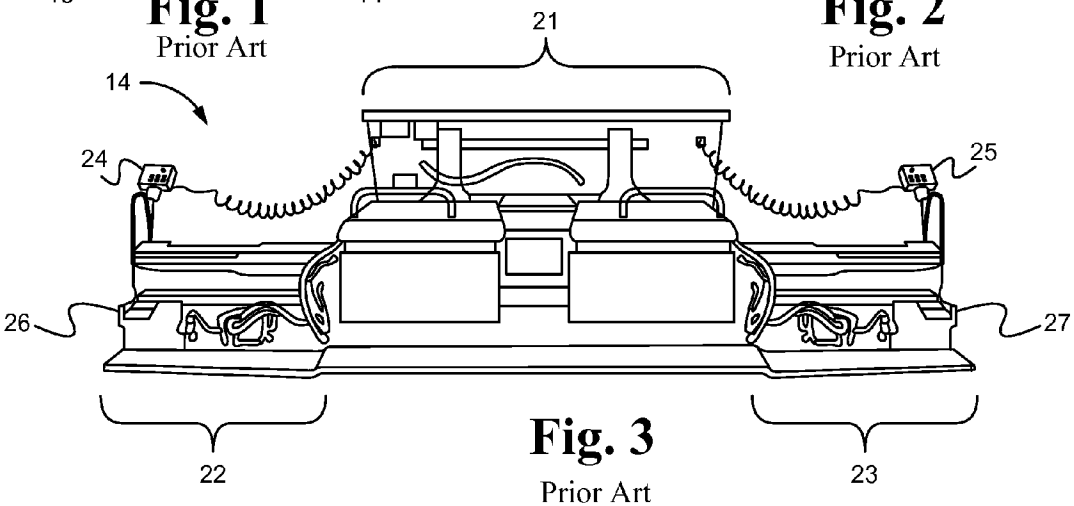
Fig. 3 Prior Art
FIG. 3 is a rear plan view of the paving screed apparatus that is towed behind the paving apparatus of FIGS. 1 and 2.
Figure 4:
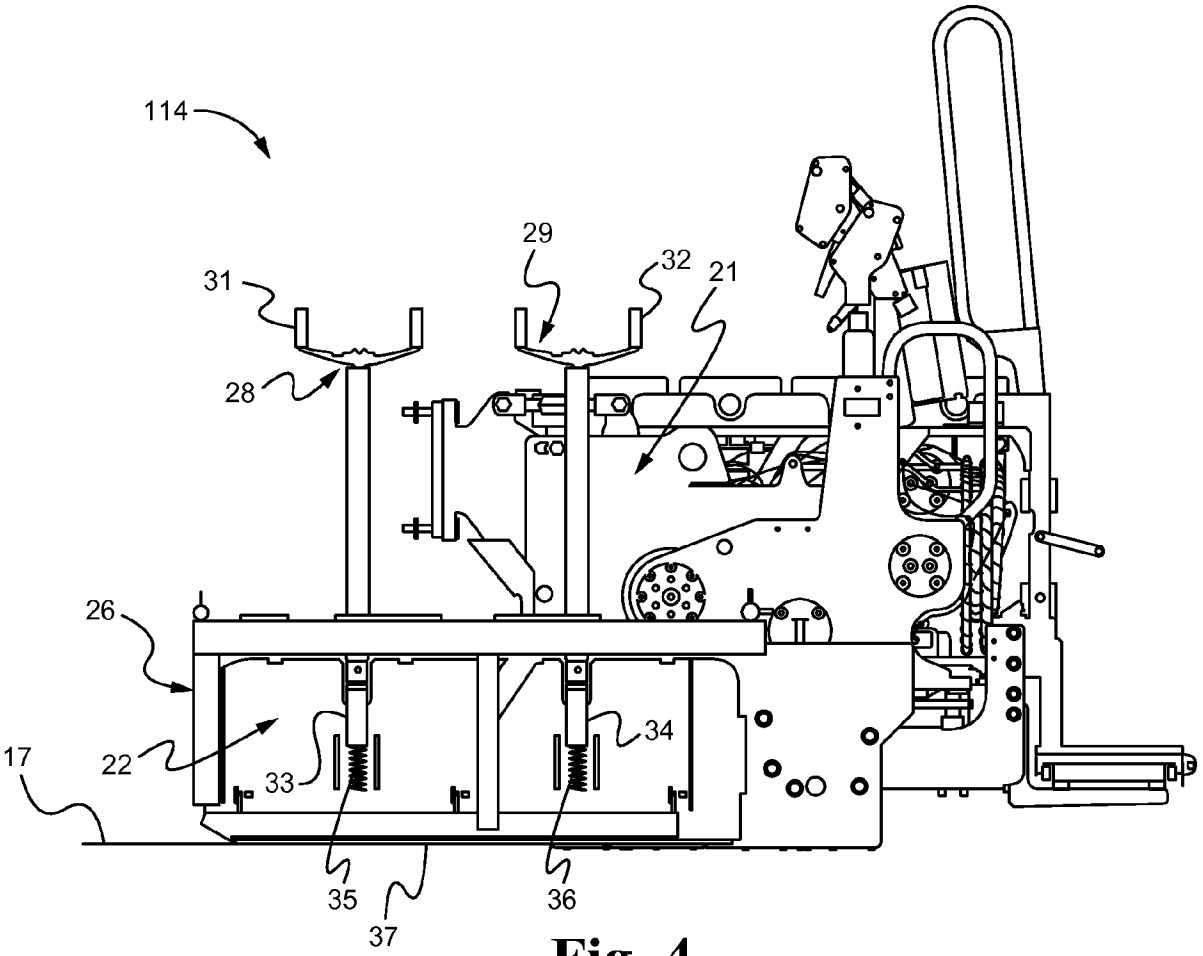
Fig. 4 Prior Art
FIG. 4 is a side view of a conventional height adjustment system for a paving screed apparatus with manually operated endgate cranks.

FIGS. 1 and 2 illustrate a paving apparatus 10 that includes an operator station 11 and a frame 12. The paving apparatus 10 also includes a hopper 13 for receiving asphalt material that is distributed by one or more augers (not shown) in front of the screed system 14, one example of which is illustrated in FIG. 3 and another example of which is illustrated in FIG. 4. The screed system 14 is towed behind the tractor 15 of the paving apparatus 10, which will typically include a plurality of ground engaging elements shown generally at 16. While the typical ground engaging elements 16 are wheels with tires, the ground engaging elements 16 may also include two or four endless tracks.

Turning to FIGS. 3 and 4, typical screed systems 14 include a main screed 21 disposed between a pair of screed extenders 22, 23. Using hydraulics or other suitable means, the extenders 22, 23 may be expanded or narrowed with respect to the main screed 21 thereby providing the operators with the ability to vary the width of the asphalt mat being laid down on the surface 17 (FIG. 4). The screed system of 14 of FIG. 3 also includes for raising or lowering the endgates 26, 27 as needed to keep the endgates in engagement with the reference surface 17 (FIG. 4) or to keep the asphalt, which has just been augured in front to the screed and screed extenders, between the endgates 26, 27.

In FIG. 4, a screed system 114 is illustrated which includes two manually operated jacks 28, 29 coupled to each endgate, such as the left endgate 26. Each manually operated jack 28, 29 includes a handle 31, 32. Each handle 31, 32 is mounted on the frame member 30 and is connected to extendable and retractable shafts 33, 34, each of which is connected to one of the springs 35, 36 respectively. In order to create a floating endgate 26, the jacks 28, 29 need to be periodically adjusted to maintain the springs 35, 36 at or near their desired setpoints or within a desired setpoint range. By not permitting the springs to fully extend or fully collapse, the endgate 26 is able to float on top of the reference surface 17. As shown in FIG. 4, both shafts 33, 34 may need to be lowered in order for the shoe 37 of the endgate 26 to engage the reference surface 17 (i.e., sub-base, curb, previously laid asphalt mat, etc.). To keep the springs 35, 36 from fully compressing or fully extending, the jacks 28, 29 must be continually manipulated by the operator.

If the mat gets too thick, the springs 35, 36 will fully extend downward towards the surface 17, but without action by the operator, the endgate 26 may max out its vertical stroke and may actually lift above and off the reference surface 17, allowing asphalt material to spill laterally outward through the gap G between the endgate 26 and the reference surface 17. In contrast, if the mat suddenly gets too thin, without action by the operator, the springs 35, 36 will reach their maximum compression, causing the endgate 26 to be pushed upward into the screed frame, which may prevent the screeds 21-23 from paving such a thin layer. To eliminate the need for the constant manual manipulation of the jacks 28, 29, as well as the jacks disposed at the other side of the screed 114 (not shown in FIG. 4), systems and methods for controlling the position of paver screed endgates 26, 27 are disclosed in FIGS. 5-16.

Figure 5:
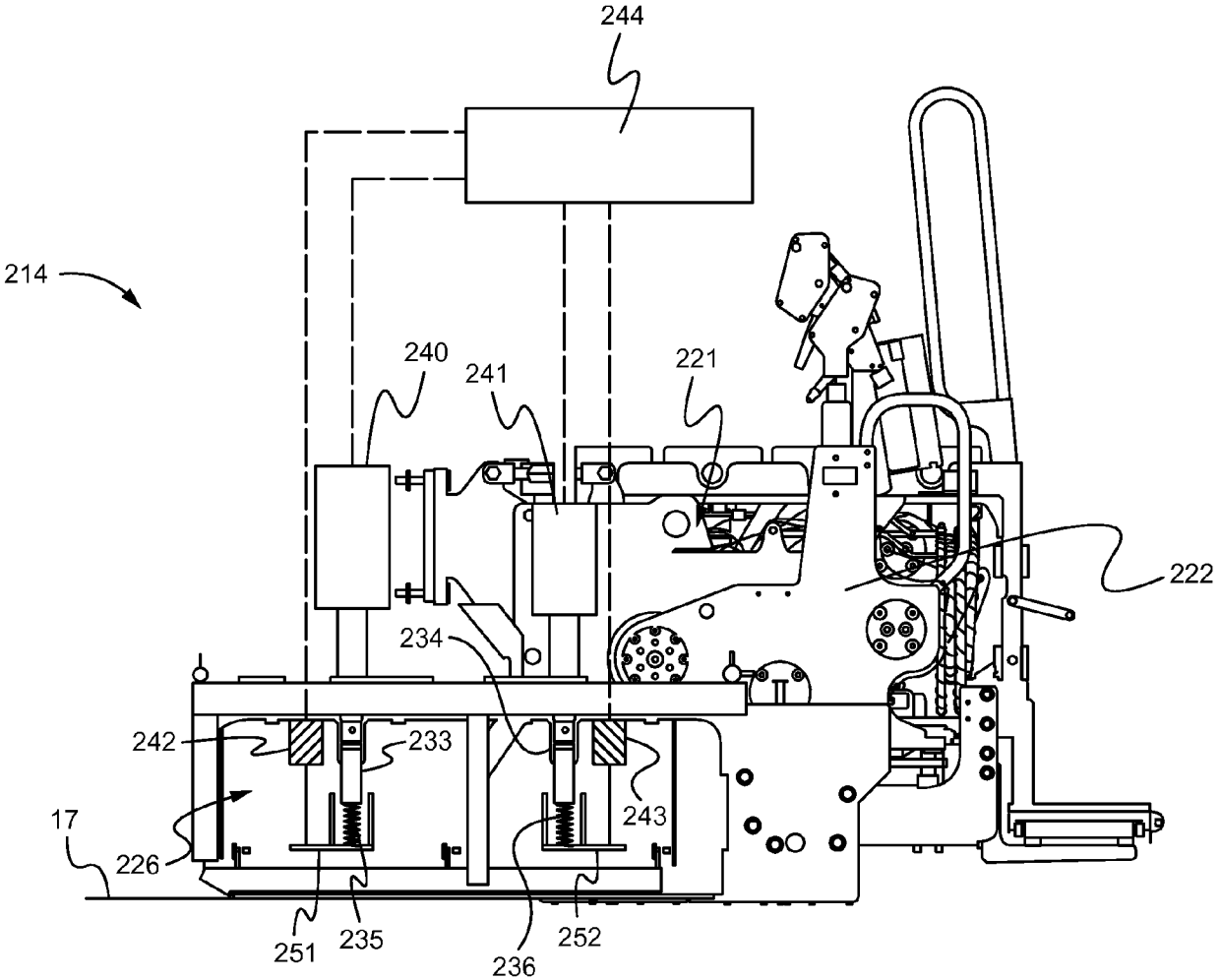
FIG. 5 is a side view of a disclosed height adjustment system for a paving screed apparatus including automated controls for adjusting the extension of the actuator, the compression of the springs and/or the height of the endgates.

Turning to FIG. 5, an improved screed system 214 includes a main screed 221 disposed between screed extenders, one of which is shown at 222. The screed system 214 also includes an endgate 226 which is coupled to two springs 235, 236. Each spring 235, 236 is coupled to its own extendable and retractable shaft 233, 234. Each shaft 233, 234 is coupled to its own actuator 240, 241 respectively. Each spring 235, 236 is also coupled to its own transducer 242, 243, which measure the linear displacement of the springs 235, 236 respectively. The transducers 242, 243 are linked to a controller 244 which is also linked to the actuators 240, 241.

Figure 6:
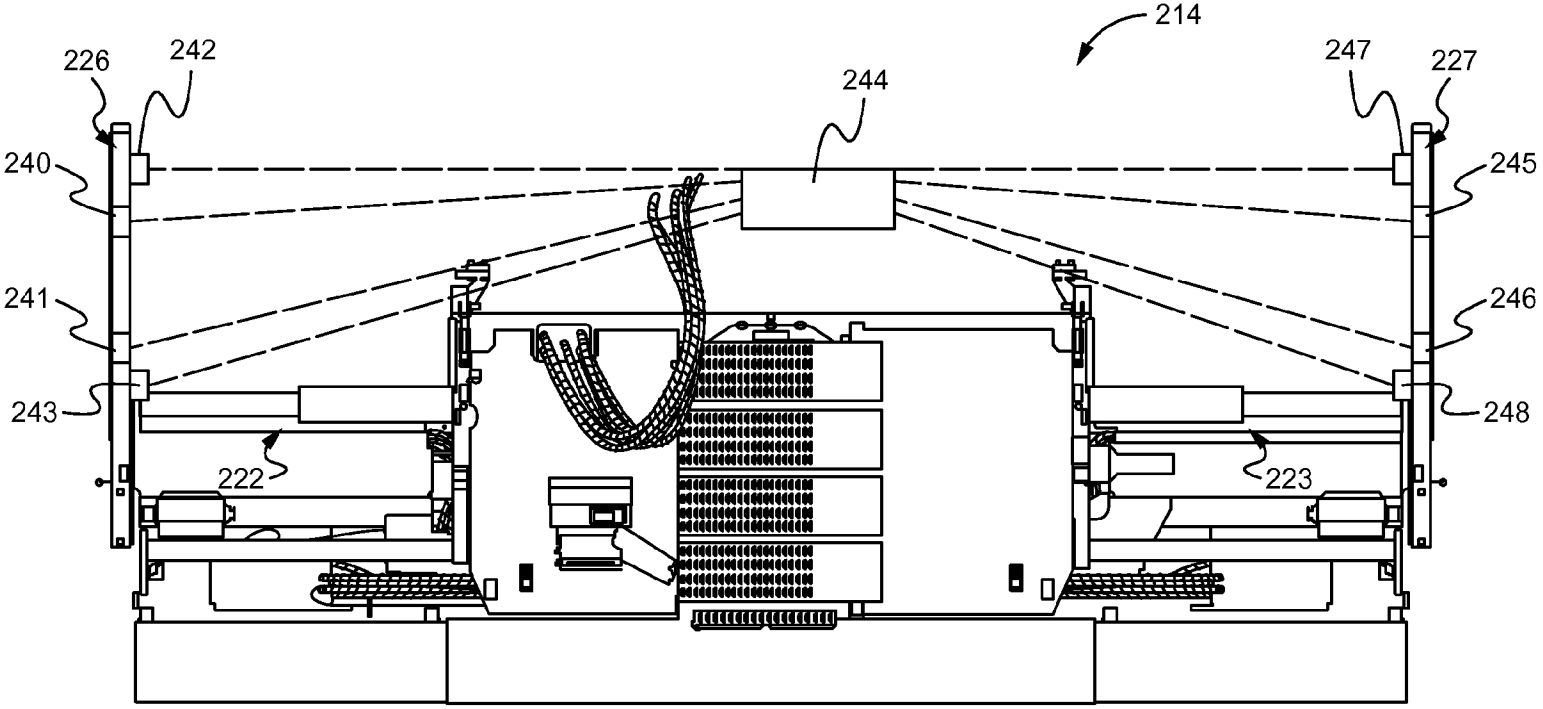
FIG. 6 is a top view of the paving screed apparatus and height adjustment system illustrated in FIG. 5.

A top view of the disclosed screed system 214 is provided in FIG. 6, which also illustrates a right endgate 227 with two actuators 245, 246 and two transducers 247, 248. In an embodiment, the transducers 242, 243, 247, 248 may be linear variable differential transducers (LVDT), which are a type of electrical transducers used for measuring linear displacement. Typically, a LVDT includes three solenoid coils placed end-to-end around a tube (not shown). The center coil is the primary and the two outer coils are the secondaries. A cylindrical ferromagnetic core is coupled to the brackets 251, 252 which support the springs 235, 236 (see FIG. 5). As the endgate 226 moves up or down, the brackets 251, 252 also move up or down thereby compressing and extending the springs 235, 236. The transducers 242, 243 measure the compression or extension of the springs 235, 236 and the controller 244 is programmed to determine whether the springs 235, 236 are compressed beyond a desired setpoint or setpoint range or extended beyond a desired setpoint or setpoint range. The controller 244 may be a microcontroller linked to the screed system 214. It is also possible to incorporate the functions of the controller 244 into the ECM module of the tractor 15 (not shown) but this may be less desirable if the screed system 214 is to be towed behind a variety of different tractors 15.

Figure 7:
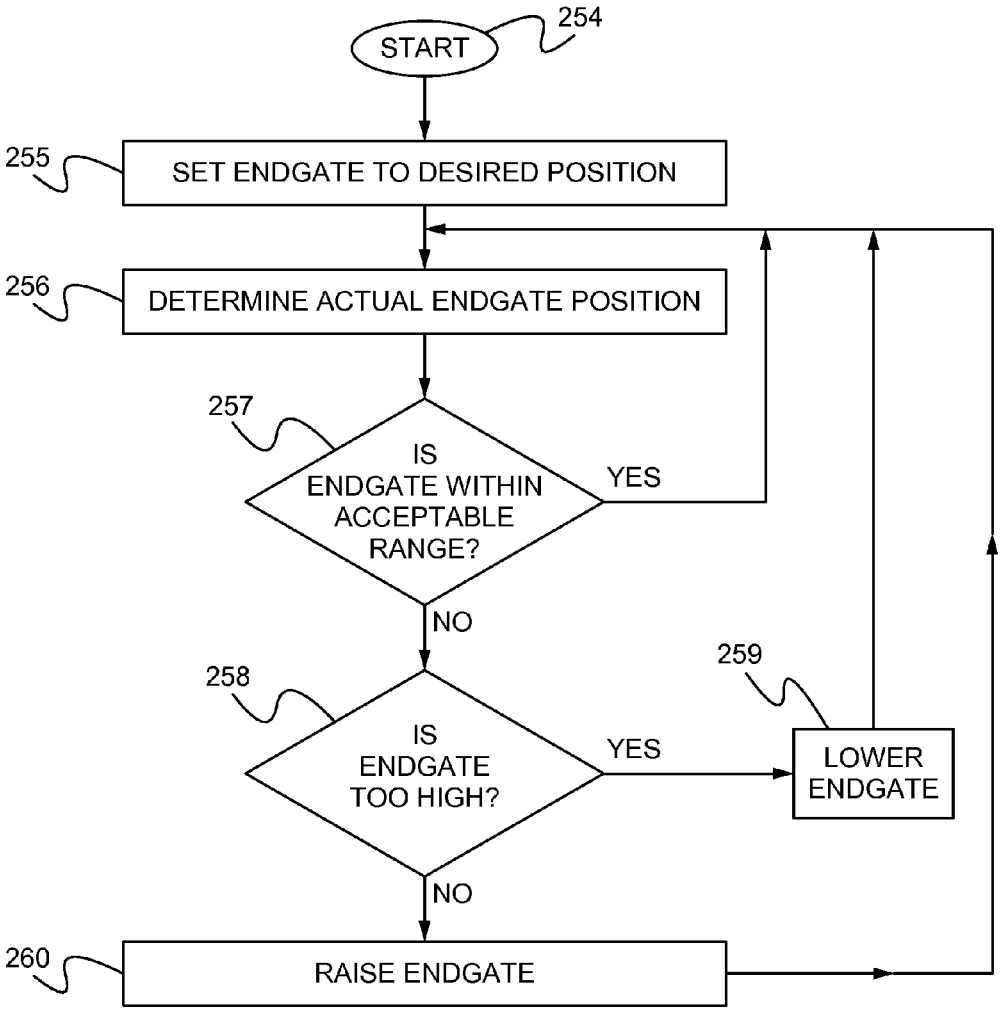
FIG. 7 is a flow chart illustrating a closed loop control system and method for continuously adjusting the height of a screed endgate.
Figure 8:
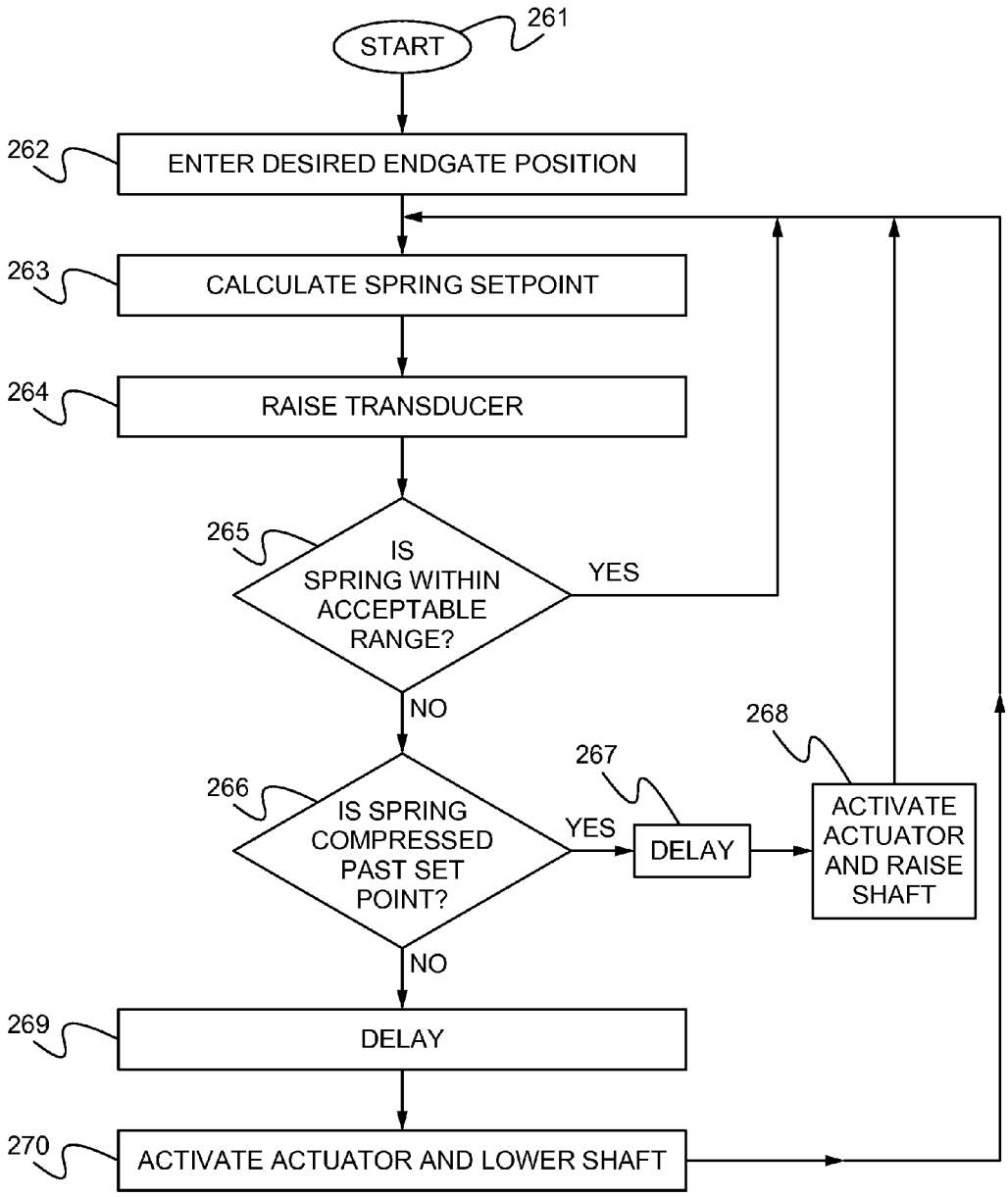
FIG. 8 is another flow chart illustrating a closed loop method and system for continuously maintaining an endgate spring at or near its setpoint.
Figure 9:
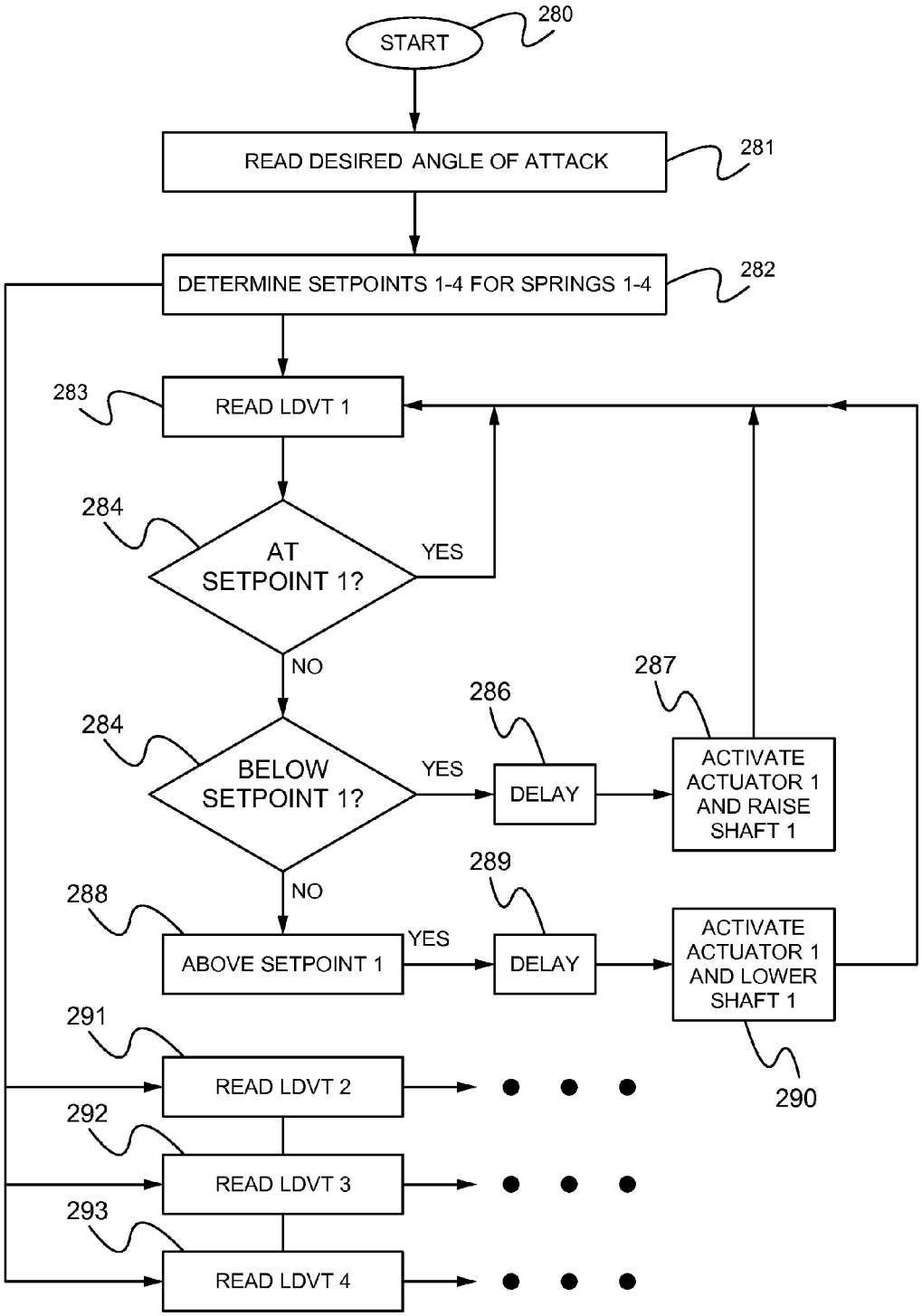
FIG. 9 is a flow chart illustrating four closed loop systems and methods for individually maintaining four endgate springs at or near their setpoints.

Various methods and algorithms for controlling the height of the endgates 226, 227 are illustrated in FIGS. 7-9. Turning to FIG. 7, the closed loop algorithm is shown for a single spring. The algorithm is initiated in the controller 244 at step 254. The operator may enter the desired endgate position at step 255. At step 256, the controller 244 receives signals from a transducer, e.g. 242, coupled to the spring 235 being monitored and the controller 244 is programmed to determine the actual position of the endgate 226 based upon the data transmitted by the transducer 242. At step 257, the controller 244 determines whether the position of the endgate 226 is within an acceptable range. If it is, the algorithm returns to step 256. If not, the algorithm proceeds to step 258 where the controller 244 determines whether the endgate 226 is too high. If it is too high, the controller 244 sends a signal to the actuator 240 to compress the endgate at step 259. Thereafter, the algorithm returns to step 256 as illustrated in FIG. 7. If the endgate 226 is not too high at step 258, the controller 244 sends a signal to the actuator 240 to extend the endgate 226 at step 260 before the algorithm returns to step 256 where data from the transducer 242 is received and interpreted again.

A similar algorithm is presented in FIG. 8. The program is initiated at 261 and the desired position of the endgate is entered by the operator at 262. The controller 244 determines the correct setpoint of the spring 235 at 263. The spring setpoint may be a neutral position for the spring 235, a slightly compressed position or a slightly extended position. After the spring setpoint is determined at 263, and the controller 244 receives data from the transducer 242 at 264. A determination as to whether the spring 235 is within an acceptable setpoint range is made at 265 and, if so, the algorithm returns to step 264 as shown in FIG. 8. If the position of the spring 235 is outside of an acceptable range, the controller determines whether the spring is compressed too beyond its setpoint range at 266. If so, an operational delay may be instituted at 267 prior to activation of the actuator 240 at 268 thereby causing the spring 235 to be extended before the algorithm returns to step 264 where the transducer 242 is read again. If the spring 235 is not compressed beyond its setpoint range at 266, an optional delay may be instituted before the actuator 240 is activated at 270 for purposes of compressing the spring 236 before the algorithm returns to step 264 as shown in FIG. 8.

FIG. 9 illustrates a similar flow chart for four springs, with two springs 235, 236 for the left endgate 226 and two additional springs for the right endgate 227 (not shown). The program is initiated at 280 and the desired angle of attack is entered by the operator and read by the controller 244 at 281. Setpoints or setpoint ranges for all four springs are determined at 282. Then, the adjustment to the endgates 226, 227 and the springs is made on an individual basis. For example, a first transducer is read at 283 by the controller 244 and a determination is made at 284 as to whether the first spring is within an acceptable range. If it is, the program returns to step 283. If not, a determination is made as to whether the spring is below its setpoint at 285 and, if it is, an optional delay is instituted at 286 before the actuator is activated at 287 for purposes of extending the spring coupled to the spring. If a determination is made that the spring is above the setpoint at 288, an optional delay is instituted at 289 and the actuator is actuated at 290 for purposes of compressing the spring. Similar close loop algorithms are carried out for the remaining three springs with only the steps of reading the transducers being indicated at 291, 292, 293 for brevity.

Figure 10:
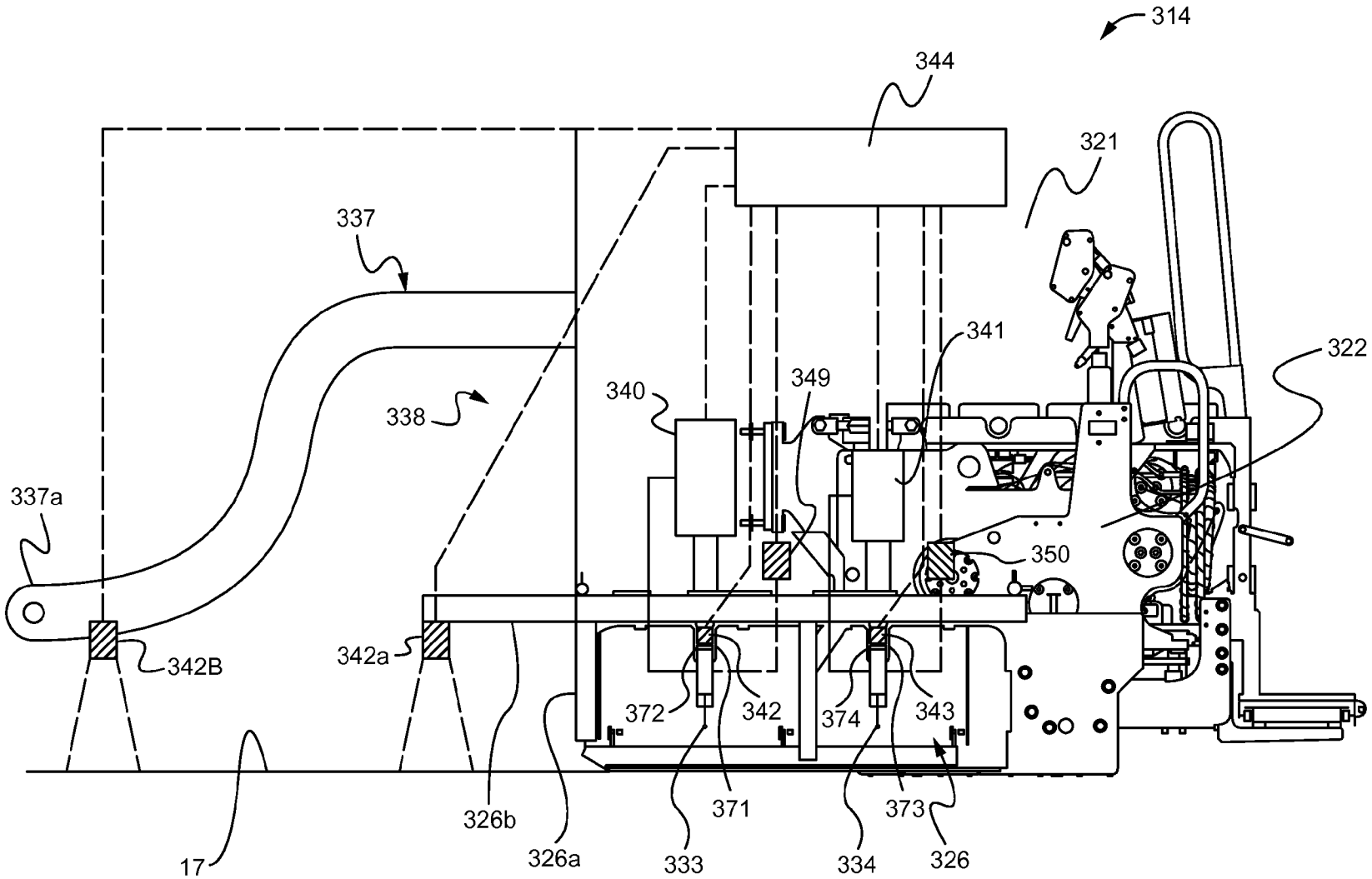
FIG. 10 is a side view of another disclosed height adjustment system for a paving screed apparatus including automated controls for adjusting the extension of the hydraulically actuated springs and/or the height of the endgates.

Turning to FIG. 10, an additional paving screed apparatus 314 is disclosed which includes a main screed 321 disposed between two screed extenders, one of which is shown at 322. The paving screed apparatus is pivotally coupled to a tractor (not shown) by a tow arm 337.

FIG. 10 also illustrates a closed loop height adjustment system 338 that includes a controller 344 and a pair of endgates, only one of which is shown at 326. The height adjustment system 338 also includes a pair of hydraulic cylinders 371, 373 that accommodate pistons 372, 374 that are coupled to extendable springs 333, 334. The cylinders 371, 373 may be equipped with sensors 342, 343 that may be used to monitor the compression or extension of the springs 333, 334. While the springs 333, 334 may be coupled directly or indirectly to the endgate 326, springs may also be employed between the springs 333, 334 and the endgate 326. The sensors 342, 343 are preferably LVDTs or pressure sensors. The sensors 342, 343 may also be linked to the controller 344. Additionally, sensors 349, 350 disposed outside of the cylinder 371, 373 may be employed for monitoring the extension or compression of the springs 333, 334. The sensors 349, 350 may also be LVDTs.

Further, sonic sensor 342*a* may be employed at a front end 326*a* of the endgate 326 or the employment of an extension 326*b* to the endgate 326. An additional placement for the sonic sensor is also shown at 342*b* at a distal end 337*a* of the tow arm 337. The purpose of the sonic sensors 342*a*, 342*b* is to maintain the shoe 375 of the endgate 326 relative vertically or with respect to the angle of attach to the grade of the surface 17. Sonic sensors 342*a*, 342*b* in front of the screed system 314 allow the system 314 to have a proactive slower adjustment, steadier operation and smoother actuation.

The extension or compression of the springs 333, 334 is provided by the hydraulic actuators 340, 341. The actuators 340, 341 may also be electric actuators, such as electric motors. In such an embodiment, the springs 333, 334 may be threaded springs coupled to electric motors that service the actuators 340, 341. The actuators 340, 341 are linked to the controller 344. Dual actuators 340, 341 are utilized to control the height of the endgate 326, the angle of attack of the endgate 326 and to maintain contact between the shoe 375 and the surface 17 or base material.

In operation, the LVDTs or pressure sensors 342, 343 or 349, 350 communicate the position of the shoe 375 to the controller 344. The controller 344 determines the actual position of the springs 333, 334 and the difference between the actual position of the springs 333, 334 and the desired setpoint range of the springs 333, 334. The controller 344 then calculates a delta value between the value or values transmitted by the sensor or sensors 342, 343 or 349, 350 and the desired setpoint ranges for purposes of generating control signals transmitted to the actuators 340, 341 to increase or decrease the extension or compression of the springs 333, 334. If the actuators 340, 341 are hydraulic actuators, they may be in the form of a hydraulic control valve that increases or decreases the pressure within the cylinders 373, 373 for increasing or decreasing the extension of the springs 333, 334. Preferably, but not necessarily, each cylinder may have additional position sensing technology, such as the sensors 349, 350 that are linked to the controller 344 for accurately maintaining the desired position or desired setpoint range of the endgate 326.

Figure 11:
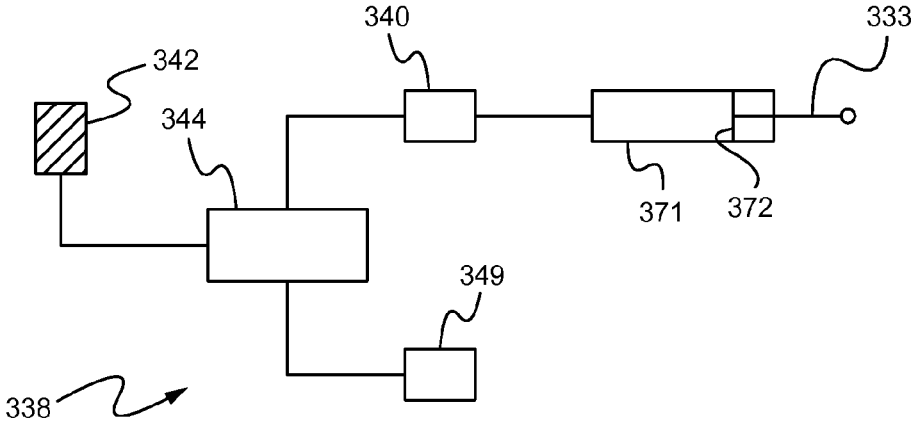
FIG. 11 is a partial hydraulic schematic illustration for the automated control system shown in FIG. 10.
Figure 12:
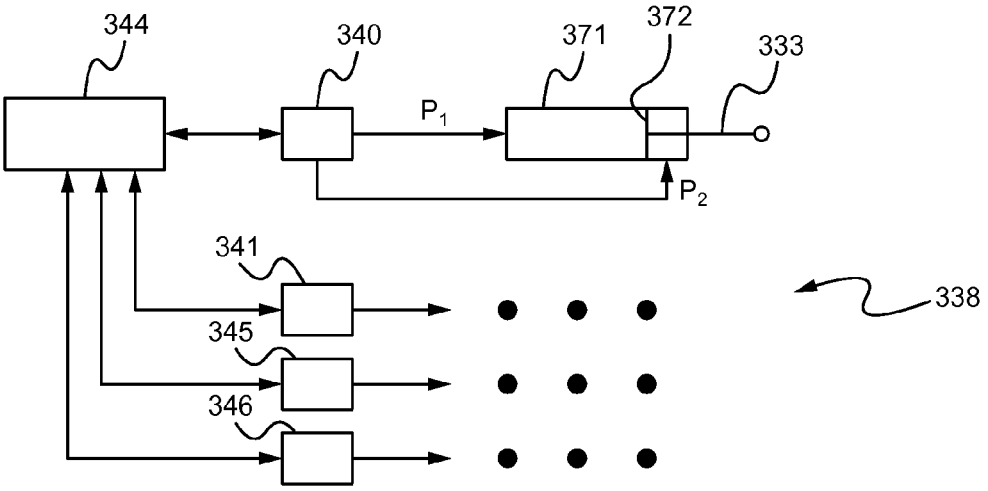
FIG. 12 is a partial electrical schematic illustration of the automated control system shown in FIG. 10.

Turning to FIG. 11, an electrical schematic for a portion of the height adjustment system 338 is illustrated with respect to a single LVDT or pressure sensor 342. The sensor 342 is linked to the controller 344 which, in turn, is linked to the actuator 340 as well as the additional sensor 349. The actuator 340 is linked to the cylinder 371, piston 372 and spring 333 as shown. In FIG. 12, a partial hydraulic schematic for the height adjustment system 338 is illustrated. The controller 344 is linked to the actuator 340 which, in turn, is coupled to the cylinder 371, the piston 372 and the spring 333 as shown. FIG. 12 also shows the communication between the controller 344 and the left rear actuator 341 as well as actuators 345, 346 associated with the right endgate (not shown in FIG. 10 or 12; see FIG. 6).

Figure 13:
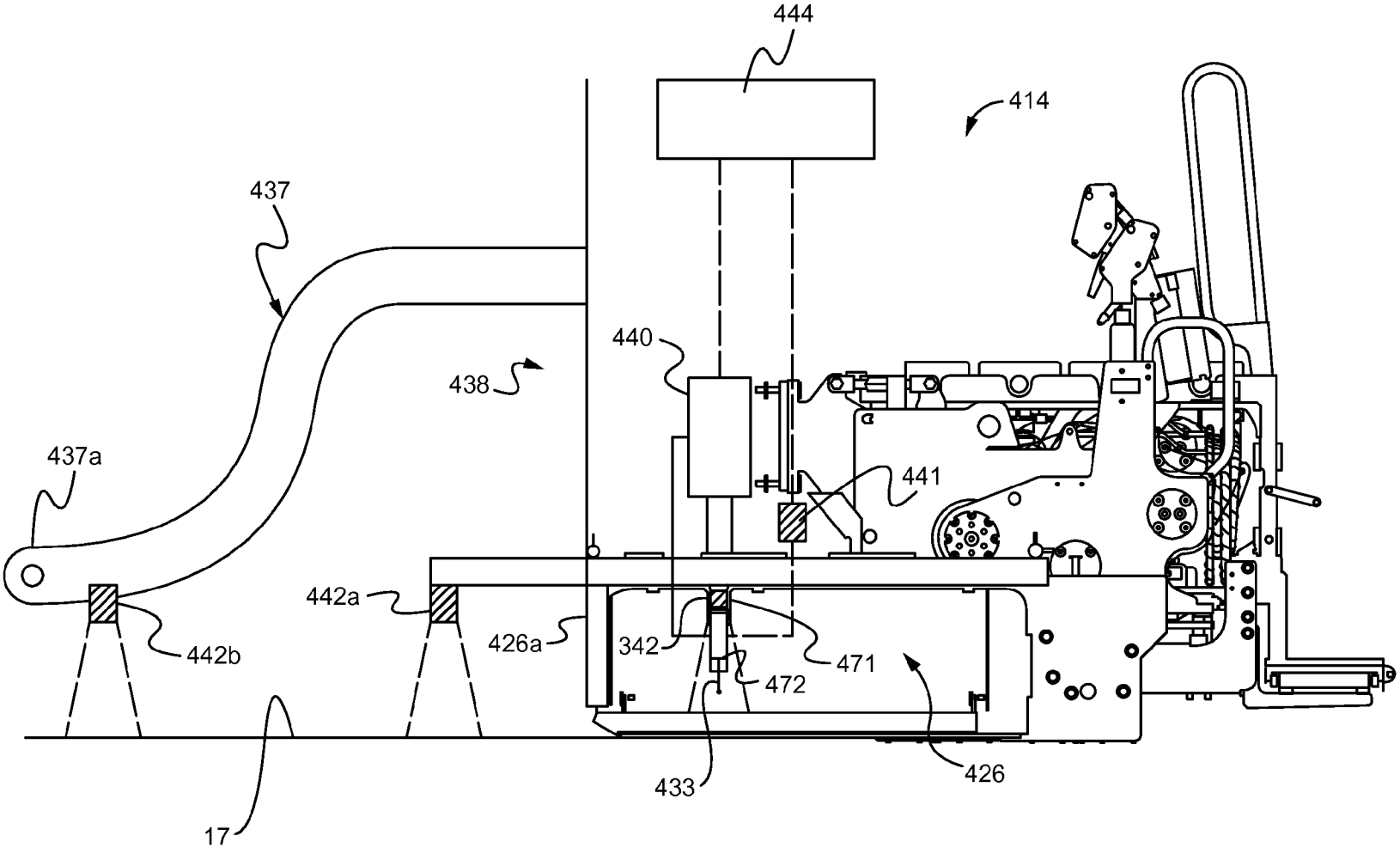
FIG. 13 is a side view of yet another disclosed height adjustment system for a paving screed apparatus utilizing a sonic sensor as shown in FIG. 10 but with a single cylinder and spring for each endgate as opposed to the dual cylinders and springs for each endgate shown in FIG. 10.

Turning to FIG. 13, a paving screed apparatus 414 is disclosed with a height adjustment system 438 having the same functional elements as the height adjustment system 338 of FIG. 10 but with a single cylinder 471, piston 472 and spring 433. A single actuator 440 is linked to the controller 444 and an optional sensor 441, which may be an LVDT, is also shown linked to the controller 444 and the cylinder 471. The LVDT or pressure sensor 342 may be placed within the cylinder 471 or outside the cylinder 471. The front end 426*a* of the endgate 426 or the distal end 437*a* of the toe arm 437 may include one or more sonic sensors 426*a*, 426*b* as explained above in connection with FIG. 10.

Figure 14:
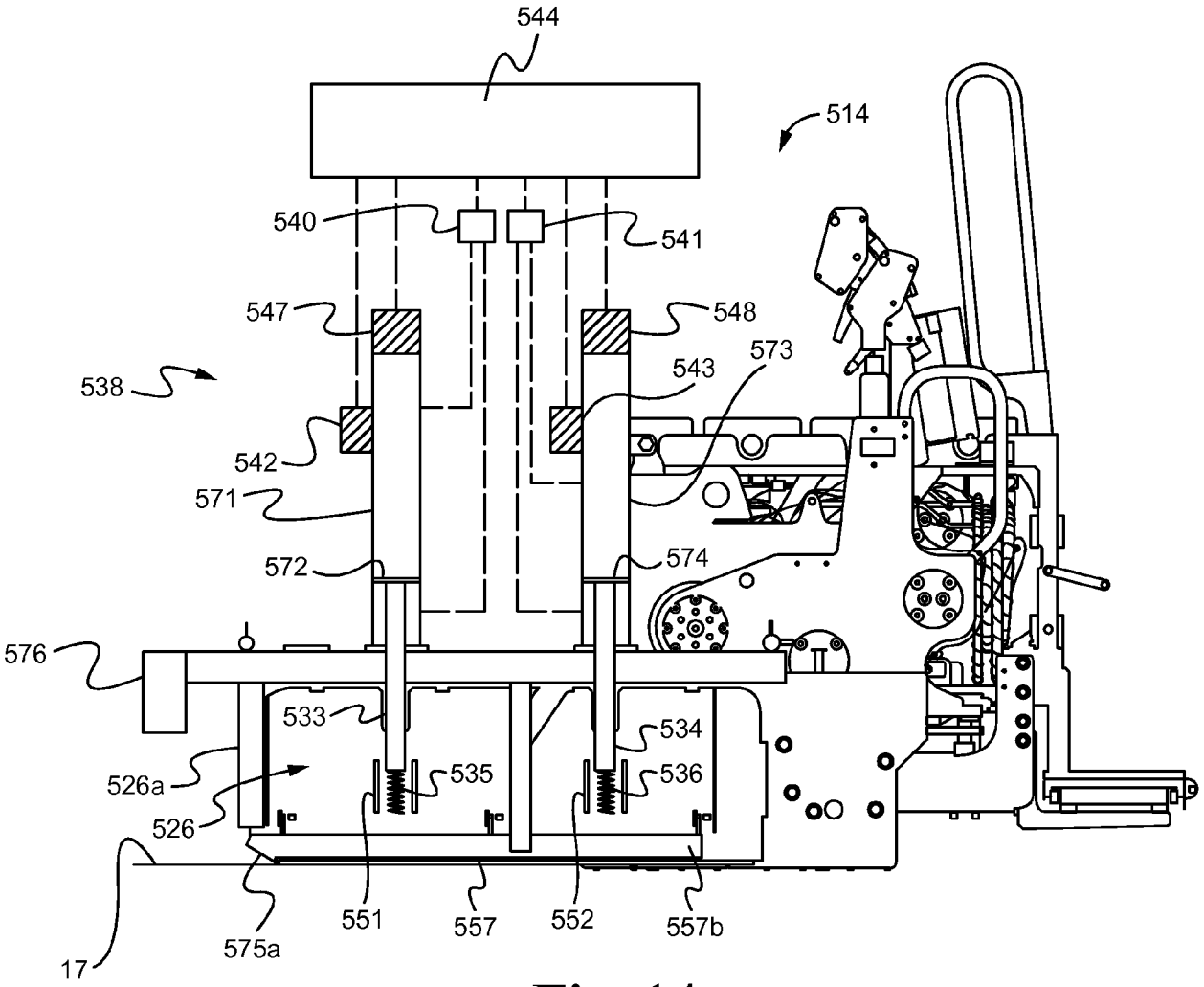
FIG. 14 is a side view of yet another disclosed height adjustment system including automated controls for adjusting the extension of the hydraulic springs, the compression of the springs and/or the height of the endgates.

Turning to FIG. 14, an additional endgate height adjustment system 538 is illustrated for a paver screed apparatus 514. The system 538 includes a controller 544, a pair of actuators 540, 541, a pair of hydraulic cylinders 571, 573 that accommodate the pistons 572, 574 respectively and that are connected to a springs 533, 534 respectively. The springs 533, 534 are coupled to springs 534, 536 as well as the brackets 551, 552 respectively that are each coupled to the endgate 526. Each cylinder 571, 573 may also be coupled to pressure sensors 542, 543 and each cylinder 571, 573 may also accommodate additional sensors 547, 548 for more accurately monitoring the position of the pistons 572, 574. The height adjustment system 538 of FIG. 14 is a closed loop control system that utilizes actuators 540, 541 for both the front cylinder 571 and rear cylinder 573. The pressure sensors 542, 543 are used to monitor the pressure within the cylinders 571, 573 which, in turn, are used to monitor the compression of the springs 535, 536. In addition to controlling the ground pressure between the shoe 575 and the grade surface 17, the height adjustment system 538 also includes LVDTs 547, 548 that may be disposed internal or external to the cylinders 571, 573 for measuring the actual position of each piston 572, 574 or spring 533, 534 respectively. Using the LVDTs it is possible to set up desired setpoint ranges for the springs 533, 534, springs 535, 536 or pistons 572, 574 to provide a desired angle of attack so that the front edge 575*a* of the shoe 575 is a desired distance above or below the back edge 575*b* of the shoe 575. Further, the system 538 can be designed to hold the front edge 575*a* of the shoe at a pre selected height above the back edge 575*b* of the shoe 575 using the LVDTs 547, 548 to measure the position of the pistons 572, 574, springs 533, 534 or springs 535, 536. The system 538 allows the shoe 575 to float on a reference grade at the rear end 575*b* of the shoe 575 but also enables the front edge 575*a* of the shoe 575 to angle upward off of the grade surface 17 to clear obstacles that typically only catch the front edge 575*a* of the shoe 575. The angle of attack control function can be engaged or disengaged at the control panel (not shown); thereby allowing the operator to transition between full floatation versus angled operation quickly and easily. The amount of the angle of attack can be set by the operator, or come set from the factory. The addition of a grade sensor 576 at the front 526*a* of the endgate 526 could also be used to identify obstructions in front of the shoe 575 and allow the system 538 to automatically add in an appropriate amount of increased angle of attack to pass over the obstacle or obstruction without any input from the operator.

The control software is stored in the memory of the controller 544 may be defined so that the pressure acting on the cylinders 571, 573 be maintained at a targeted value that equates to the reaction force of the springs 535, 536 at a desired amount of spring compression. The amount of desired spring compression may be set by the operator prior to activating the height adjustment system 538, or the desired amount of spring compression may be preset at the factory.

The control of the cylinders 571, 573 may include a deadband ranging from about 5% to about 20% of the target pressure. The use of a deadband allows the shoe 575 to float naturally using the springs 535, 536. If the pressure changes by more than the deadband value, e.g. 12%, the cylinders 571, 573 would be individually activated automatically to bring the individual pressures back to the targeted values for the desired spring compressions. The deadband values may be optimized based on testing. The cylinders 571, 573 could also be used to run the endgate shoe 575 manually when the system 538 is not activated, thereby removing the need for hand crank operation of the endgate shoe 575 using jacks.

Figure 15:
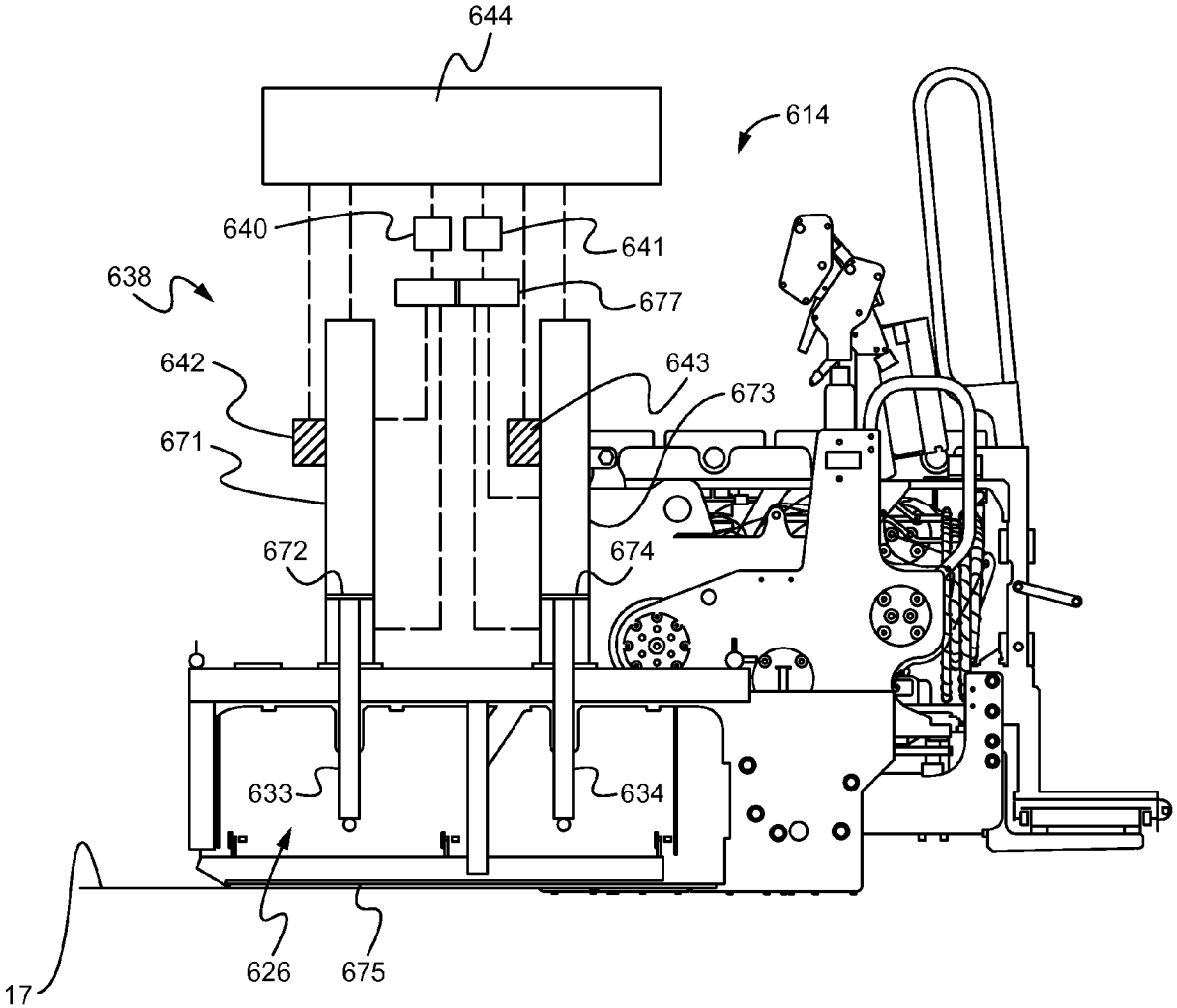
FIG. 15 is yet another disclosed height adjustment system for a paving screed apparatus that does not employ springs, but includes automated controls for adjusting the extension of hydraulic cylinder shafts, the employment of an accumulator for purposes of delaying the extension or retraction of the shafts and the employment of pressure sensors that transmit the pressure acting on each cylinder by engagement or lack of engagement of the endgates with the reference surface.

Turning to FIG. 15, yet another paving screed apparatus 614 is disclosed with a automated height adjustment system 638 that includes all of the elements of the system 538 shown in FIG. 14 with the exception of the LVDTs 547, 548, the springs 535, 536 and the brackets 551, 552. However, springs 535, 536 and brackets 551, 552 may be included. The closed loop height adjustment system 638 utilizes hydraulic cylinders 671, 673 that are each equipped with pressure sensors 642, 643 and which accommodate pistons 672, 674 and springs 633, 634 respectively. The control software stored in the memory of the controller 644 may be defined so that the pressure acting within each cylinder 671, 673 is maintained at a targeted value that equates to a desired amount of ground pressure between the shoe 675 and the grade surface 17. The desired amount of ground pressure could be set by the operator prior to turning on the automated height control system 638 or be preset at the factory. The desired ground pressure could be changed, depending on jobsite conditions such as paving over a solid grade versus matching a hot asphalt joint. Accordingly, the operator needs the ability to vary the desired pressure setpoint range, should jobsite conditions require such a change. The pressure setpoint range may also include a deadband value, ranging from about 5% to about 20% of a target setpoint pressure thereby creating a desired target pressure setpoint range which may minimize and/or optimize the frequency adjustments made due to changes in conditions at the surface 17. If the pressure changes by more than the deadband value, the cylinder or cylinders 571, 573 could be actuated automatically to bring the pressure back to within the targeted pressure setpoint range for the desired surface pressure. The deadband value could be optimized based on testing and can be made adjustable by the operator during use. FIG. 15 also illustrates the use of an optional accumulator 677 with separate chambers that is coupled to the actuators 640, 641 for increasing the response time, or instituting a delay, which may be used to smooth system pulsations. The cylinders 671, 673 remove the need for a hand crank operation of the endgate shoe 675 and therefore can be operated without leaving the control station.

Figure 16:
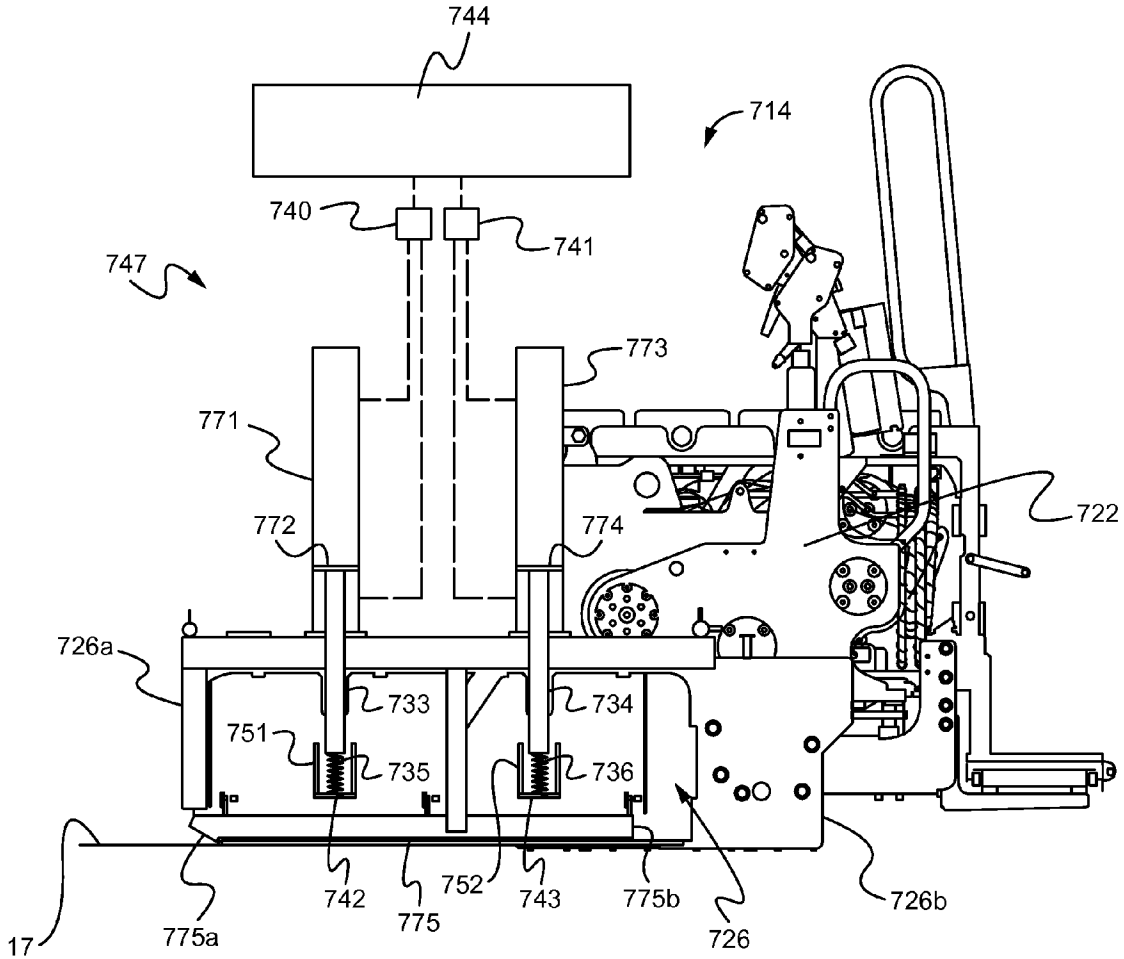
FIG. 16 is a side view of yet another disclosed height adjustment system for a paving screed apparatus including the automated controls for adjusting the extension of the springs, the compression of the springs and/or the height of the endgates, wherein the automated controls include load cells associated with each hydraulic cylinder.

Finally, yet another disclosed paving screed apparatus 714 is disclosed in FIG. 16 with a height adjustment system 747 that includes a controller 744 linked to a pair of actuators 740, 741 that are coupled to the cylinders 771, 773. Each cylinder 771, 773 accommodates a piston 772, 774 which is coupled to a spring 733, 734 respectively. The springs 733, 734 may be coupled to springs 735, 736 and brackets 751, 752. The height adjustment system 747 also includes load cells 742, 743.

The load cells 742, 743 are part of the closed loop height adjustment control system 747 that utilizes the hydraulic cylinders 771, 773 for adjusting both the front end 775*a* and rear end 775*b* of the shoe 775 or, more generally, the front end 726*a* and rear end 726*b* of the endgate 726. The location of each spring 735, 736 may be equipped with a load cell 742, 743 as shown in FIG. 16 that measures the compressive force of the springs 735, 736 on the surface 17. The control software could be designed so that the force of the springs 735, 736 acting on the load cells 742, 743 is maintained at a targeted value or value range that equates with the desired spring travel height. The desired spring travel height may be set by the operator prior to turning on the automated height adjustment control system 747, or be preset at the factory. The designed spring travel height could be changed depending on jobsite conditions, e.g. paving over a solid grade versus matching a hot asphalt joint.

Accordingly, the operator may need the ability to vary the control parameters on the jobsite, depending on jobsite conditions. The control of the cylinders 771, 773 may include a deadband, ranging from about 5% to about 20% of the target force to minimize and/or optimize the frequency of adjustments made due to changes in the conditions of the grade or surface 17. If the compressive force changes by more than the deadband value, one or both of the cylinders 771, 773 would be actuated by the actuators 740, 741 respectively to bring the compressive forces back to the targeted values for the desired height of the springs 735, 736. The deadband value may be optimized based on testing and possibly made adjustable during operations by the operator. The cylinders 771, 773 also remove the need for hand crank operation of the endgate shoe 775 and may be operated without leaving the control station.

INDUSTRIAL APPLICABILITY

A screed system with an automated system for adjusting the endgate heights is disclosed. The endgates may include one or more springs. Each spring may be coupled to a spring which is coupled to an actuator. The actuators may be linked to a controller. Each spring may be coupled to a sensor, which may be a LVDT, a pressure sensor, a sonic sensor or a grade sensor. The sensor or sensors may also be linked to the controller. The operator may enter the desired angle of attack or endgate height or position. From this information, the controller calculates either the appropriate endgate position, spring position, piston position, shoe position, spring position or spring compressive force and thereafter determines the appropriate setpoints for the front and rear cylinders or the single cylinder for a system like that shown in FIG. 13. In a closed loop fashion, the system monitors the condition of the spring, piston spring or end gate sensor(s) and communicates that data to the controller and when the measured condition is out of tolerance or outside an acceptable setpoint range, the controller activates the actuator for that cylinder for purposes of extending or compressing the spring coupled between the actuator and the spring. In the disclosed system and methods, the monitoring and adjusting of the springs, springs, pistons, endgate, etc. is done individually or independently of the other elements. However, for systems with two cylinders at each endgate, the control of the cylinders of a particular endgate may be coordinated.

The disclosed system may be easily retrofitted into existing paving screed systems or may be offered as original equipment on new paving screed systems.

What is claimed is:

1. A height adjustment system for an endgate of a paving screed apparatus, the height adjustment system comprising:

an endgate coupled to a first spring, the first spring coupled to a first actuator, the first actuator linked to a controller, the controller including a memory;

the first spring being movable between a compressed position and an extended position with a first setpoint range disposed therebetween, the first setpoint range is stored in the memory of the controller;

a first sensor for detecting an actual position of the first spring, the first sensor is linked to the controller;

the controller is programmed to extend the first actuator and extend the first spring when the first spring is compressed beyond the first setpoint range; and the controller is programmed to compress the first actuator and compress the first spring when the first spring and the endgate are extended beyond the first setpoint range.

2. The system of claim 1 wherein the first setpoint range includes a first setpoint and a first deadband ranging from about +/−5% to about +/−20% of the first setpoint.

3. The system of claim 1 wherein the controller is further programmed to delay extending the first spring when the first spring is compressed beyond the first setpoint range; and the controller is further programmed to delay compressing the first spring when the first spring is extended to a position beyond the first setpoint range.

4. The system of claim 1 wherein the first sensor is selected from the group consisting of a linear variable differential transducer, a pressure sensor, a load cell and a sonic sensor.

5. The system of claim 1 wherein the first actuator is selected from the group consisting of: an electric motor coupled to a threaded shaft; a first combination of a hydraulic control valve and a hydraulic cylinder; and a second combination of a hydraulic control valve, an accumulator and a hydraulic cylinder.

6. The system of claim 1 wherein the endgate includes a shoe, the shoe having a front end and a rear end, the shoe being coupled to the first spring and a second spring that is disposed between the first spring and the rear end of the shoe, the second spring is coupled to a second actuator, the second actuator is linked to the controller;

the second spring being movable between a compressed position and an extended position with a second setpoint range disposed therebetween, the second setpoint range is stored in the memory of the controller;

a second sensor for detecting an actual position the second spring, the second sensor is linked to the controller;

the controller is programmed to cause the second actuator to extend the second spring when the second spring and the endgate are compressed beyond the second setpoint range; and the controller is programmed to compress the second actuator when the second spring and the endgate are extended beyond the second setpoint range.

7. The system of claim 6 wherein the second setpoint range includes a second setpoint and a second deadband ranging from about +/−5% to about +/−20% of the second setpoint.

8. The system of claim 6 wherein the controller is further programmed to delay extending the second spring when the second spring and the endgate are compressed beyond the second setpoint range; and wherein the controller is further programmed to delay compressing the second spring when the second spring is extended to a position beyond the second setpoint range.

9. The system of claim 6 wherein the second sensor is selected from the group consisting of a linear variable differential transducer, a pressure sensor, a load cell and a sonic sensor.

10. The system of claim 6 wherein the second actuator is selected from the group consisting of: an electric motor coupled to a threaded shaft; a first combination of a hydraulic control valve and a hydraulic cylinder; and a second combination of a hydraulic control valve, an accumulator and a hydraulic cylinder.

11. The system of claim 1 wherein the first actuator and the first spring include a first hydraulic cylinder that accommodates a piston connected to a first shaft that retractably extends out of the first hydraulic cylinder and is coupled to the endgate.

12. A paving apparatus, comprising:

a main screed including a main screed plate disposed between a right extender and a left extender;

the right extender is disposed between the main screed plate and a right endgate, the right endgate is coupled to a right spring, the right spring is coupled to a right actuator;

the left extender is disposed between the main screed plate and a left endgate, the left endgate is coupled to a left spring, the left spring is coupled to a left actuator;

the right and left actuators are linked to a controller;

the right spring is movable between extended and compressed positions with a right setpoint range disposed therebetween, the left spring is movable between extended and compressed positions with a left setpoint range disposed therebetween, a right sensor for detecting displacement of the right spring with respect to the right setpoint range, a left sensor for detecting displacement of the left spring with respect to the left setpoint range, the right and left sensors are linked to the controller;

the controller is programmed to the cause the right actuator to extend the right spring when the right spring is compressed beyond the right setpoint range, the controller is also programmed to compress the right actuator to compress the right spring when the right spring is extended beyond the right setpoint range;

the controller further programmed to the cause the left actuator to extend the left spring when the left spring is compressed beyond the left setpoint range, and the controller programmed to cause the left actuator to compress the left spring when the left spring is extended beyond the left setpoint range.

13. The apparatus of claim 12 wherein the right setpoint range includes a right setpoint and a right deadband ranging from about +/−5% to about +/−20% of the right setpoint; and the left setpoint range includes a left setpoint and a left deadband ranging from about +/−5% to about +/−20% of the left setpoint.

14. The paving apparatus of claim 12 wherein the controller is further programmed to delay extending the right spring when the right spring is compressed beyond the right setpoint range;

the controller is further programmed to delay compressing the right spring when the right spring is extended to a position beyond the right setpoint range;

the controller is further programmed to delay extending the left spring when the left spring is compressed beyond the left setpoint range;

the controller is further programmed to delay compressing the left spring when the left spring is extended to a position beyond the left setpoint range.

15. The apparatus of claim 12 wherein the right sensor and the left sensor are selected from the group consisting of a linear variable differential transducer, a pressure sensor, a load cell and a sonic sensor.

16. The apparatus of claim 12 wherein the right actuator and the left actuator are selected from the group consisting of: an electric motor coupled to a threaded shaft; a first combination of a hydraulic control valve and a hydraulic cylinder; and a second combination of a hydraulic control valve, an accumulator and a hydraulic cylinder.

17. The apparatus of claim 12 wherein the right endgate includes a right shoe, the right shoe having a front end and a rear end, the right shoe being coupled to the right spring and a right rear spring that is disposed between the right spring and the rear end of the right shoe, the right rear spring is coupled to a right rear actuator, the right rear actuator is linked to the controller, the controller including a memory;

the right rear spring is movable between a compressed position and an extended position with a right rear setpoint range disposed therebetween, the right rear setpoint range is stored in the memory of the controller;

a right rear sensor linked to the controller, the right rear sensor detecting an actual position of the right rear spring and communicating the actual position of the right rear spring and the right endgate to the controller;

the controller is programmed to the cause the right rear actuator to extend the right rear spring when the right rear spring and the right endgate are compressed beyond the right rear setpoint range;

the controller is programmed to the cause the right rear actuator to compress the right rear spring when the right rear spring and the right endgate are extended beyond the right rear setpoint range;

the left endgate includes a left shoe, the left shoe having a front end and a rear end, the left shoe being coupled to the left spring and a left rear spring that is disposed between the left spring and the rear end of the left shoe, the left rear spring is coupled to a left rear actuator, the left rear actuator is linked to the controller;

the left rear spring is movable between a compressed position and an extended position with a left rear setpoint range disposed therebetween, the left rear setpoint range is stored in the memory of the controller;

a left rear sensor linked to the controller, the left rear sensor detecting an actual position of the left rear spring and communicating the actual position of the left rear spring to the controller;

the controller is programmed to the cause the left rear actuator to extend the left rear spring when the left rear spring is compressed beyond the left rear setpoint range; and the controller is programmed to the cause the left rear actuator to compress the left rear spring when the left rear spring is extended beyond the left rear setpoint range.

18. The apparatus of claim 17 wherein the controller is further programmed to delay extending the right rear spring when the right rear spring is compressed beyond the right rear setpoint range;

the controller is further programmed to delay compressing the right rear spring when the right rear spring is extended to a position beyond the right rear setpoint range;

the controller is further programmed to delay extending the left rear spring when the left rear spring is compressed beyond the left rear setpoint range; and the controller is further programmed to delay compressing the left rear spring when the left rear spring is extended to a position beyond the left rear setpoint range.

19. The apparatus of claim 17 wherein the right rear sensor and the left rear sensor are selected from the group consisting of a linear variable differential transducer, a pressure sensor, a load cell and a sonic sensor.

20. The apparatus of claim 17 wherein the right rear actuator and the left rear actuator are selected from the group consisting of: an electric motor coupled to a threaded shaft; a first combination of a hydraulic control valve and a hydraulic cylinder; and a second combination of a hydraulic control valve, an accumulator and a hydraulic cylinder.

21. The apparatus of claim 12 wherein the right and left actuators each include a hydraulic cylinder that accommodates a piston connected to a shaft that retractably extends out of the hydraulic cylinder and is coupled to the right and left endgates respectively.

22. A method for operating a height adjusting system of a paving apparatus, the paving apparatus including a right endgate and a left endgate, the right endgate coupled to a right spring, the left endgate coupled to a left spring, the right spring linked to a right sensor and the right spring coupled to a right actuator, the left spring linked to a left sensor and the left spring coupled to a left actuator, the right and the left actuators and the right and the left sensors linked to a controller, the method comprising:

determining a right setpoint range for the right spring and determining a left setpoint range for the left spring;

receiving a signal from the right sensor and determining whether the right spring is compressed or extended beyond the right setpoint range and receiving a signal from the left sensor and determining whether the left spring is compressed or extended beyond the left setpoint range;

if the right spring is compressed beyond the right setpoint range, activating the right actuator and extending the right spring to adjust the right spring to a position within the right setpoint range;

if the left spring is compressed beyond the left setpoint range, activating the left actuator and extending the left spring to adjust the left spring to a position within the left setpoint range;

if the right spring is extended beyond the right setpoint range, activating the right actuator and compressing the right spring to adjust the right spring to a position within the right setpoint range; and if the left spring is extended beyond the left setpoint range, activating the left actuator and compressing the left spring to adjust the left spring to a position within the left setpoint range.

23. The method of claim 22 further including delaying for a time period after the receiving of the signals from the right and left sensors and before the extending or the compressing of the right and left springs.

24. The method of claim 22 wherein the extending and compressing of the right spring is independent of the extending and compressing of the left spring and vice versa.

25. The method of claim 22 further comprising:

providing a grade sensor in front of the right and left endgates that is linked to the controller;

receiving at least one signal from the grade sensor at the controller identifying an obstruction and a size of the obstruction in front of the paving apparatus; and adjusting the right and left setpoint ranges for right and left springs respectively based on the size of the obstruction.

* * * * *